US005209493A

United States Patent [19]

Chernek

[11] Patent Number: 5,209,493

[45] Date of Patent: May 11, 1993

[54] PORTABLE SAUCER GOLF GAME

[75] Inventor: Frank Chernek, Fairview, Pa.

[73] Assignee: BWI, Inc., Fairview, Pa.

[21] Appl. No.: 847,714

[22] Filed: Mar. 4, 1992

[51] Int. Cl.[5] ..... A63B 67/00

[52] U.S. Cl. ..... 273/411; 273/402

[58] Field of Search ..... 273/411, 398, 399, 400, 273/401, 402, 32 R, 34 R

[56] References Cited

U.S. PATENT DOCUMENTS 4,792,143 12/1988 Headrick ..... 273/400

*Primary Examiner*—William H. Grieb

*Attorney, Agent, or Firm*—Longacre & White

[57] ABSTRACT

The present invention is directed to a portable saucer golf game in which the players arrange the course according to the available space and their particular skill level. The game is played by placing rings at various locations, whereby a player throws a saucer disk toward a ring with the intent of getting the saucer completely within the ring to finish the hole. The player using the fewest throws to complete the course is the winner.

12 Claims, 2 Drawing Sheets

PORTABLE SAUCER GOLF GAME

BACKGROUND OF THE INVENTION a) Field of the Invention

The present invention pertains to a saucer golf game which is played by applying the same principals as regular golf. The nature of the game permits the player to arrange the holes according to the available space, and/or the skill of the players involved.

b) Description of Related Art

Due to the popularity of outdoor games that permit one or more players to participate, many attempts have been made to provide games that are easy to set up and cater to players of different ages and skill levels. For example, a popular games called yard darts is played by placing hoops at various locations in one's yard. Players then attempt to throw large darts into the hoops to score points. However, due to the inherently dangerous nature of yard darts and injuries that resulted, the game has fallen into disuse and has been outlawed in some areas. Horseshoes is another sport gaining increased popularity in recent years. However, horseshoes is a game particularly suited for a certain skill level and does not permit rapid set-up. In addition, the terrain upon which horseshoes is played tends to be severely damaged during play. Horseshoes can also be dangerous if played carelessly.

In recent years, the saucer disk has gained great popularity. Playing with a saucer disk is inexpensive, safe, and permits players of various skill levels to play together. In fact, a variation upon the game of football has recently developed in which a saucer disk is passed down a playing field. An opposing team attempts to defend their end zone by forcing the opposing team to drop the saucer disk. Teams score by successfully crossing into the opposing team's end zone.

In addition, saucer golf has gained popularity in recent years. Saucer golf is played on an established playing course and players attempt to use as few throws as possible to land the saucer into an established metal basket. However, the availability of saucer golf courses is limited. Furthermore, these courses do not permit the players to arrange the playing field to suit their specific skill level. Instead, these courses are permanently arranged and are often too difficult or remotely located for children to play.

SUMMARY OF THE INVENTION

It is the object of this invention to provide a saucer game which overcomes the aforementioned problems by providing a saucer disk game which can be arranged according to the player's ability and the degree of difficulty desired. Therefore, a quick, safe, and easy game is provided permitting players of different skill levels to play together in whatever space is available.

It is also the object of the instant invention to provide a saucer golf game which can be played at any desired location such as a yard, a park, at the beach, or in the woods.

Another object is to provide a saucer golf game in which the degree of difficulty can be altered by changing the distance and/or number of obstacles such as trees, houses, and other natural or man-made obstacle.

Another object is to provide a saucer golf game in which the degree of difficulty can be altered by changing the size of the ring into which the saucer is thrown.

DESCRIPTION OF THE PREFERRED EMBODIMENT

Figure 1:
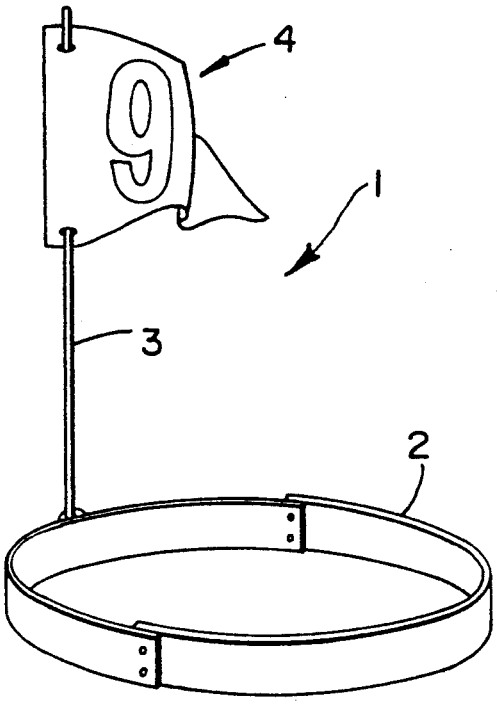
FIG. 1 is an isometric view of the ring and flag assembly of the instant invention.

FIG. 1 is an isometric view of the ring assembly of the instant invention. The ring assembly 1 is constructed by connecting the straps 2 together in order to form a ring. The straps 2 are formed of a plastic material suitable for outdoor use and which can be easily shaped into rings of different diameters. Typically, two straps are connected together to form a ring as shown in FIG. 1, however, larger or smaller rings can be formed simply by connecting the proper number of rings to form the desired ring size. This allows players to change the degree of difficulty by forming rings of desired diameter.

With reference to FIGS. 1 and 5–9, construction of the ring assembly will be described. The straps 2 are provided with snaps 21. These snaps 21 are formed as tangs on the straps 2 and are force fitted into corresponding holes 22 located at an opposite end the strap 2. The rings are formed by bending the straps into an appropriate arc in order to fit the snaps 21 into holes 22, as shown in FIG. 1.

After forming the ring of desired size, a flag 4 may be mounted on the ring assembly by flag post 3. The flag 4 is typically constructed from any material suitable for outdoor use. For this reason, any type of plastic, vinyl, or treated cloth material is preferred. The flag 4 is provided with holes 42 through which the stanchion 3 is inserted. The stanchion 3 is provided with first and second protrusions 33 and 34. The first protrusion 33 is of a size which permits its insertion through holes 42, however, the protrusion 33 is large enough to ensure that flag 4 remains in an upright position once mounted on the stanchion 3. The second protrusion 34 serves to prevent the flag from sliding down the stanchion 3. Thus, the size of protrusion 34 is larger than the diameter of the holes 42 provided on the flag 4. This ensures that the flag and any number printed on the flag is visible to all players from a reasonable distance on the playing course.

Figure 6:
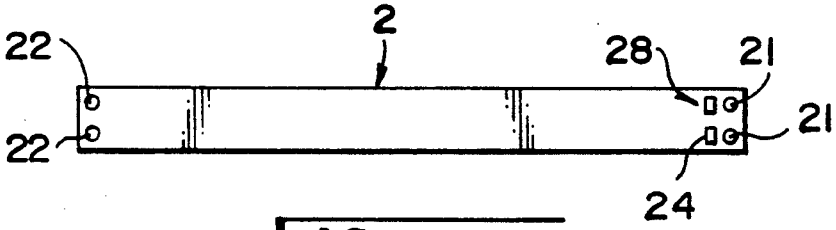
FIG. 6 is a top view of the straps used to construct the ring assembly of the instant invention.
Figure 7:
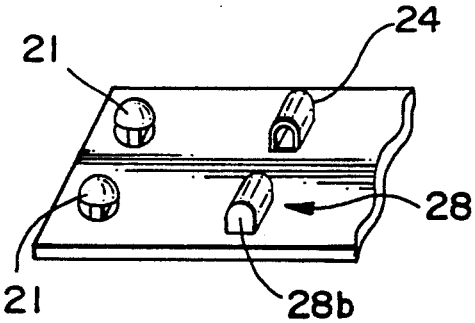
FIG. 7 is an isometric view of an end of the strap of FIG. 6 having snaps and the flag post mounting members.
Figure 8:
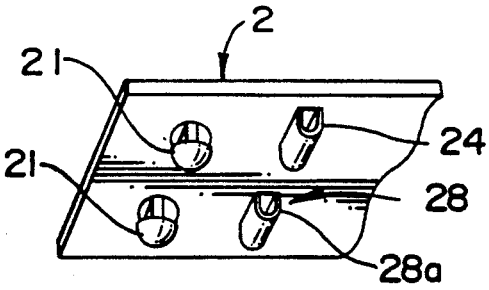
FIG. 8 is a second isometric view of the end of the strap of FIG. 6 having snaps and the flag post mounting members.
Figure 9:
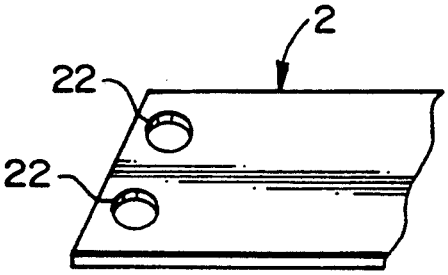
FIG. 9 is an isometric view of the end of the strap of FIG. 6 having holes into which fit snaps.

Once the flag is placed on the stanchion 3, it is secured to the ring assembly as shown in FIG. 1. In order to accomplish flag mounting, the straps 2, used to form the ring assembly, are provided with first and second mounting portions 24 and 28, as shown in FIGS. 6–8. The stanchion 3 is attached to the ring at these mounting portion by simply inserting the stanchion into the receiving holes of these mounting portions. The second mounting portion 28 is provided with an opening 28*a* on one side only. The other side is closed off by wall 28*b* as shown in FIG. 7. Thus, the stanchion 3 is insert through first mounting portion 2 and into second mounting portion 28. This structure prevents the stanchion from sliding through mounting portions. Instead, the stanchion is maintained in a sturdy, upright position; ensuring visibility of the ring assembly.

Figure 2:
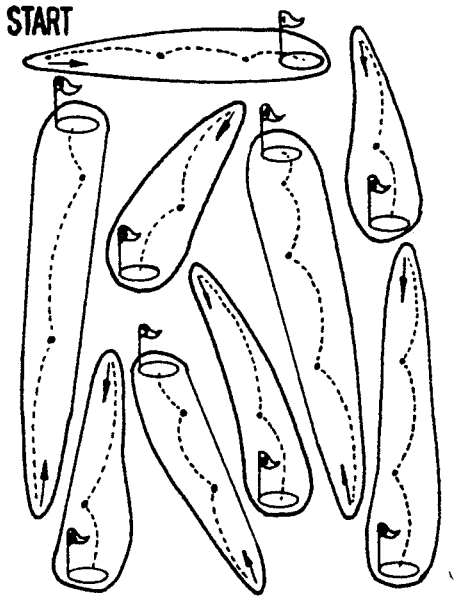
FIG. 2 is a schematic representation of a typical playing course for the instant invention.
Figure 3:
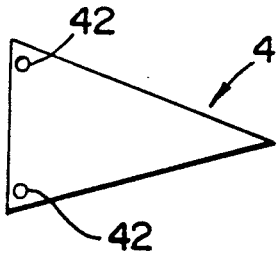
FIG. 3 is a front view of the flag used as a visual indicator for the ring assembly.
Figure 4:
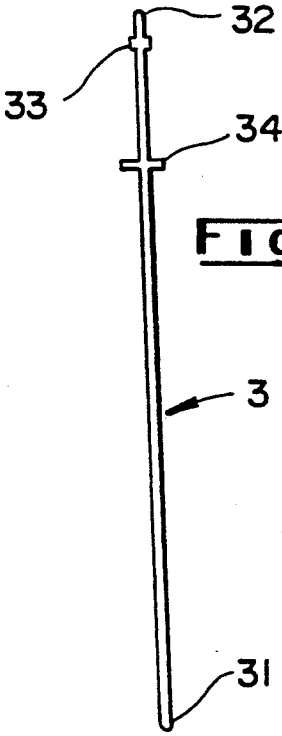
FIG. 4 is a front view of the flag post used to mount the flag onto the ring structure.
Figure 5:
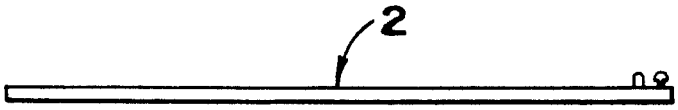
FIG. 5 is a side view of the straps used to construct the ring assembly of the instant invention.

The principals of the saucer golf game of the present invention will now be described. The saucer golf game is played by applying the same principals as regular golf. Once the desired number of ring assemblies 1 have been constructed, the players then arrange the holes according to available space. An example of such an arrangement is shown on FIG. 2. Holes are arranged by placing the ring assemblies at various locations within the available space. The number of holes set up can range from 1 to 9 according to the available space. If all 9 holes are set up, players can play 18 holes by reversing play from 9 to 1 or by replaying 1 to 9. A novelty of the instant invention lies in the fact that the players can rearrange the course if they are not satisfied with the initial set-up. Holes can be arranged according to preferred distance of players, based on ability and degree of difficulty desired. Degree of difficulty can be increased by distance and/or obstacles such as trees, houses, and other natural or man-made obstacles. As stated previously, degree of difficulty may also be changed by increasing or decreasing the diameter of the rings used to designate each hole.

Figure 10:
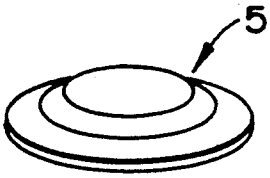
Fig- 10 PRIOR ART
FIG. 10 is an isometric view of a prior art saucer of the type used in the instant invention.

Once course set-up is complete, each player throws a plastic, saucer-shaped disc, of the type shown in prior art FIG. 10, through the air toward the ring assembly with the intent of getting the saucer completely in the ring to finish the hole. As shown by dotted lines in FIG. 2, the player continues from the location where the previous throw landed. The hole is completed when the saucer is entirely within the ring of the corresponding hole. The player then moves on to the next sequential hole. Each throw counts as one stroke and the player with the lower number of strokes on each hole wins. Score can be kept by recording the total strokes for the entire course or by recording the winner of each hole.

In order to facilitate the portability of the instant invention, a portable carrying case is provided for transportation and/or storage of the saucer golf game described above. The carrying case simply consists of a plastic case which opens to receive disassembled ring assembly member 1 and the saucers 5.

The advantages of the instant invention are numerous. The portability of the game not only allows the game to be arranged according to individual ability, but allows for play in any permitted location such as the yard, the park, the beach, or the woods.

Furthermore, the instant invention is capable of being played by persons of virtually any age.

The present invention is a simple, safe, and flexible game that permits players of all skill levels to enjoy a competitive outdoor game.

While the invention has been particularly shown and described with reference to a preferred embodiment, it will be understood by those having ordinary skill in the art that various changes in form and detail may be made therein without departing from the spirit and scope of the invention.

We claim:

1. A method of playing a game comprising the steps of:

forming a circular member having a diameter;

extending a visual indicating device from said circular member in a direction intersecting a plane formed by said diameter of said circular member;

placing said circular member on a surface within an available space to divide said space into a first area within said circular member and a second area outside of said circular area, wherein a successful throw comprises landing a plate-shaped saucer onto said surface completely within said first area;

throwing said plate-shaped saucer through the air toward said first area with the intent of attaining a successful throw;

repeating said throwing step until a successful throw is attained; and counting the number of throws employed to attain a successful throw.

2. The method according to claim 1 whereby the step of forming said circular member comprises:

connecting a second end of a first strap to a first end of a second strap;

bending said first and second straps to form an arc; and connecting a first end of said strap to a second end of said second strap.

3. The method according to claim 1 wherein said circular member is adapted to be formed of a variable diameter during said forming step whereby a varying degree of difficulty may be attained.

4. The method according to claim 1 whereby the step of extending said visual indicating device from said circular member comprises:

inserting a stanchion into a mounting means located on said circular member; and affixing a visual indicator to said stanchion.

5. The method according to claim 4 whereby the step of affixing said visual indicator to said stanchion further comprises the step of passing said stanchion through a plurality of holes located in said visual indicator.

6. The method according to claim 1 further comprising the step of relocating said circular member on a different surface to redefine said first area and said second area.

7. A method of playing a game comprising the steps of:

forming a plurality of circular members, each having a diameter;

extending a visual indicating device from each of said circular members in a direction intersecting a plane formed by said diameters of said circular members;

placing each of said circular members on a surface within an available space to divide said space into a first area within each of said circular members and a second area outside each of said circular members, wherein a successful throw comprises landing a plate-shaped saucer onto said surface completely within said first area;

throwing said plate-shaped saucer through the air toward said first area with the intent of attaining a successful throw;

repeating said throwing step until a successful throw is attained; and counting the number of throws employed to attain a successful throw.

8. The method according to claim 7 whereby the step of forming each of said plurality of circular members comprises:

connecting a second end of a first strap to a first end of a second strap;

bending said first and second straps to form an arc; and connecting a first end of said first strap to a second end of said second strap.

9. The method according to claim 7 wherein each of said circular members are adapted to be formed of a variable diameter during said forming step whereby a varying degree of difficulty may be attained.

10. The method according to claim 7 whereby the step of extending said visual indicating device from each of said circular member comprises:

inserting a stanchion into a mounting means located on each of said circular member; and affixing a visual indicator to each of said stanchions.

11. The method according to claim 10 whereby the step of affixing said visual indicator to each of said stanchions further comprises the step of passing each of said stanchions through a plurality of holes located in each of said visual indicators.

12. The method according to claim 7 further comprising the step of relocating said circular members on different surfaces redefining each of said first and second areas.

* * * * *